US006360707B1

(12) United States Patent
Boegner

(10) Patent No.: US 6,360,707 B1
(45) **Date of Patent: *Mar. 26, 2002**

(54) SOLENOID SWITCH FOR STARTERS

(75) Inventor: Karlheinz Boegner, Neuhausen (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/341,355

(22) PCT Filed: Oct. 9, 1998

(86) PCT No.: PCT/DE98/02986

§ 371 Date: Jul. 9, 1999

§ 102(e) Date: Jul. 9, 1999

(87) PCT Pub. No.: WO99/26266

PCT Pub. Date: May 27, 1999

(30) Foreign Application Priority Data

Nov. 8, 1997 (DE) ..... 197 50 889
Apr. 1, 1998 (DE) ..... 198 14 504

(51) Int. Cl.[7] ..... F02N 11/08

(52) U.S. Cl. ..... 123/179.25; 290/38 R; 335/126

(58) Field of Search ..... 123/179.1, 179.25; 290/38 R; 335/124, 126; 318/430, 431

(56) References Cited

U.S. PATENT DOCUMENTS

| | | | | |
|---|---|---|---|---|
| 1,044,562 A | | 11/1912 | Mudge | 420/28 |
| 4,305,002 A | * | 12/1981 | Mortensen | 290/38 R |
| 5,159,908 A | * | 11/1992 | Eyermann et al. | 123/179.1 |
| 5,677,656 A | | 10/1997 | Mauch et al. | 335/126 |

FOREIGN PATENT DOCUMENTS

| | | |
|---|---|---|
| GB | 1418396 | * 12/1975 |

* cited by examiner

*Primary Examiner*—Andrew M. Dolinar
(74) *Attorney, Agent, or Firm*—Michael J. Striker

(57) ABSTRACT

An engagement relay for starters of internal combustion engines as proposed, with which a starter pinion is first shifted into the gear ring of the engine and then the starter motor is turned on. For gently rotating the starter pinion into the gear ring by means of the starter motor, it is proposed that the switch of the engagement relay be embodied as a switchover contact 54, which in the position of repose switches the starter motor via a resistor 39 and in the working position switches it directly to the electrical supply (plus 30), and then the resistor (3) is turned off.

4 Claims, 4 Drawing Sheets

SOLENOID SWITCH FOR STARTERS

BACKGROUND OF THE INVENTION

The invention is based on an engagement relay for starters of an internal combustion engine. The windings and circuits previously used in such starters, which are designed for winding equality between the pull-in winding and the retention winding in order to avoid an induction retention force after the opening of the ignition switch by the reverse current flowing via the relay switch contact to the pull-in winding and the retention winding, led to an increase pull-in speed of the engagement relay for shifting the starter pinion into the gear ring of the engine, so that part of the advantage of the two-staged process is lost again.

SUMMARY OF THE INVENTION

Accordingly, it is an object of the present invention to provide an engagement relay for starters which avoids the disadvantages of the prior art.

In keeping with these objects, one feature of present invention resides, briefly stated, in an engagement relay for starters of internal combustion engines, in which the switch is formed as a switch over contact, which in the position of repose switches the starter motor for gentle start up to the electrical supply via a resistor and directly to it in the working position, and then the resistor is turned off.

This is achieved in an advantageous way by disposing a contact pair in insulated fashion below the contact plate of the relay. In the position of repose, the contact plate rests on this contact pair and thus forms a so-called "opener". Once the relay armature touches the switch pin, and once the pinion of the starter has reached the gear ring of the engine, this opener opens and turns off the resistor, before the contact plate meets the main current contacts. In the turn-off process, the opener is not closed again until the main current has been interrupted.

Because of the separate triggering, it is possible to adapt both the resistor and the pull-in winding to requirements independently of one another. The resistor wire is wound in meander fashion and then curved to form a ring so that the beginning and end are located side by side, and then is finally slipped onto the pull-in winding.

Further advantages of the invention will become apparent from the dependent claims, the ensuing description, and the drawing.

BRIEF DESCRIPTION OF THE DRAWINGS

The drawing, in FIG. 1, shows a longitudinal section through an engagement relay for starters; FIGS. 6 and 7 are shown on a larger scale.

DESCRIPTION OF THE PREFERRED EMBODIMENT

Figure 1:
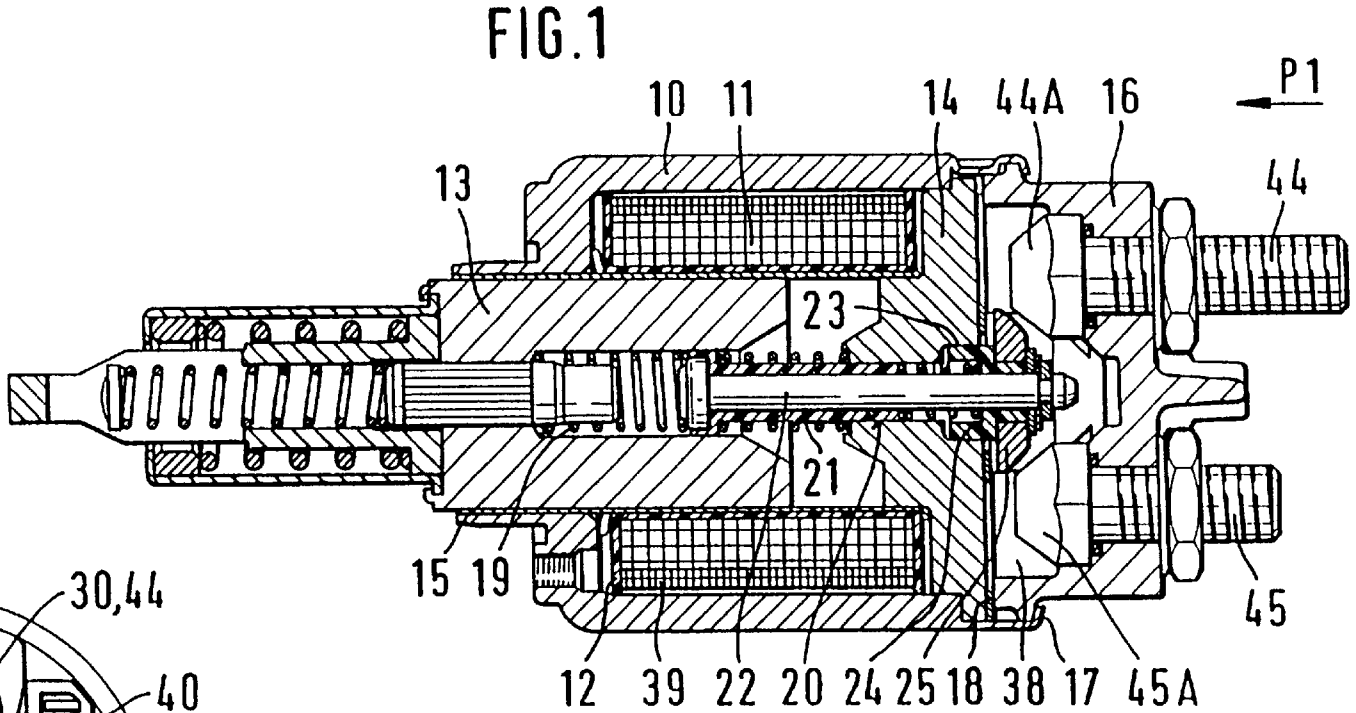

In FIG. 1, the substantially cylindrical relay housing of the engagement relay is identified by reference numeral 10. A pull-in winding 11 is disposed on its inside and is seated on a winding holder 12. In the winding holder, a cylindrical magnet armature 13 is guided in a guide sleeve 15. The relay housing 10 is closed on one side by a magnet core 14, of the kind also shown on a larger scale in FIG. 6. The magnet armature 13 rests on the opposite side of the magnet core and can be moved axially counter to the force of an anchor restoring spring 19 by suitable triggering of the pull-in winding 11.

The magnet core 14 is adjoined by a switch cap 16, which is firmly retained by a crimped ring 17 of the relay housing 10. A cup spring 18 is also located between these two parts.

In a continuous bore 20 of the magnet core 14, an insulating sleeve 21 is axially displaceable and it receives a so-called switch pin 22, which is guided through the magnet core 14 and extends as far as the inside of the switch chamber of the switch cap 16. The bore 20 in the magnet core 14 has a widened bore stage 23, in which an insulating bush 24, through which the switch pin extends, is disposed. A contact plate 25 is secured to the outer end of the insulating bush 24 and is braced against a shoulder of the insulating bush 24. The contact plate is firmly retained on the end of the switch pin 22 by an insulating disk 26 and a fastening disk 27. One end of a compression spring 28 presses against the end of the insulating sleeve 21 opposite the contact plate 26, and the other end of this spring is braced against the insulating sleeve 21.

Figure 3:
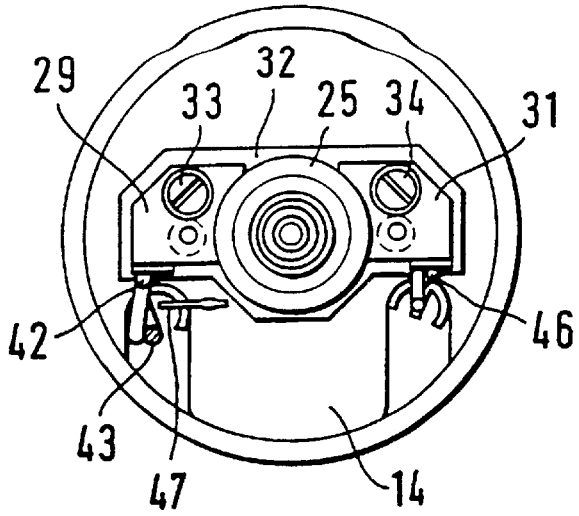
in FIG. 3, a front view with the switch cap removed.
Figure 4:
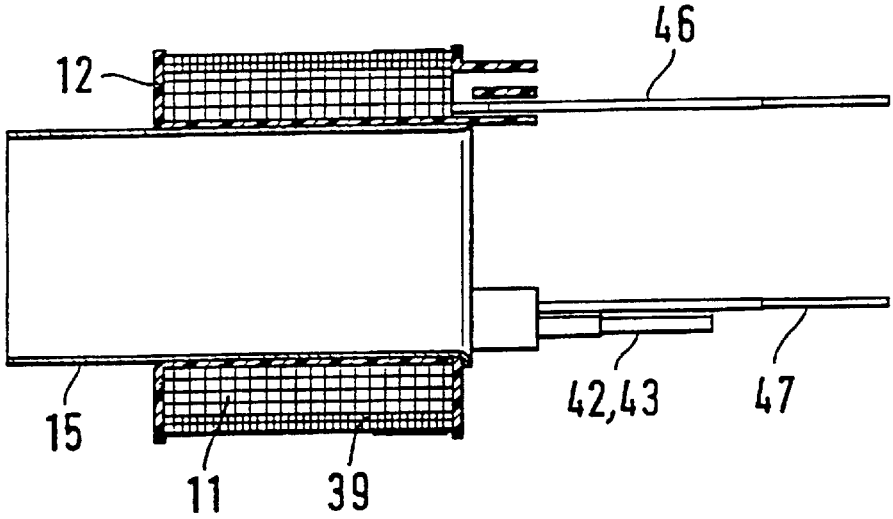
in FIG. 4, a detail of FIG. 1 (pull-in winding with resistor)
Figure 7:
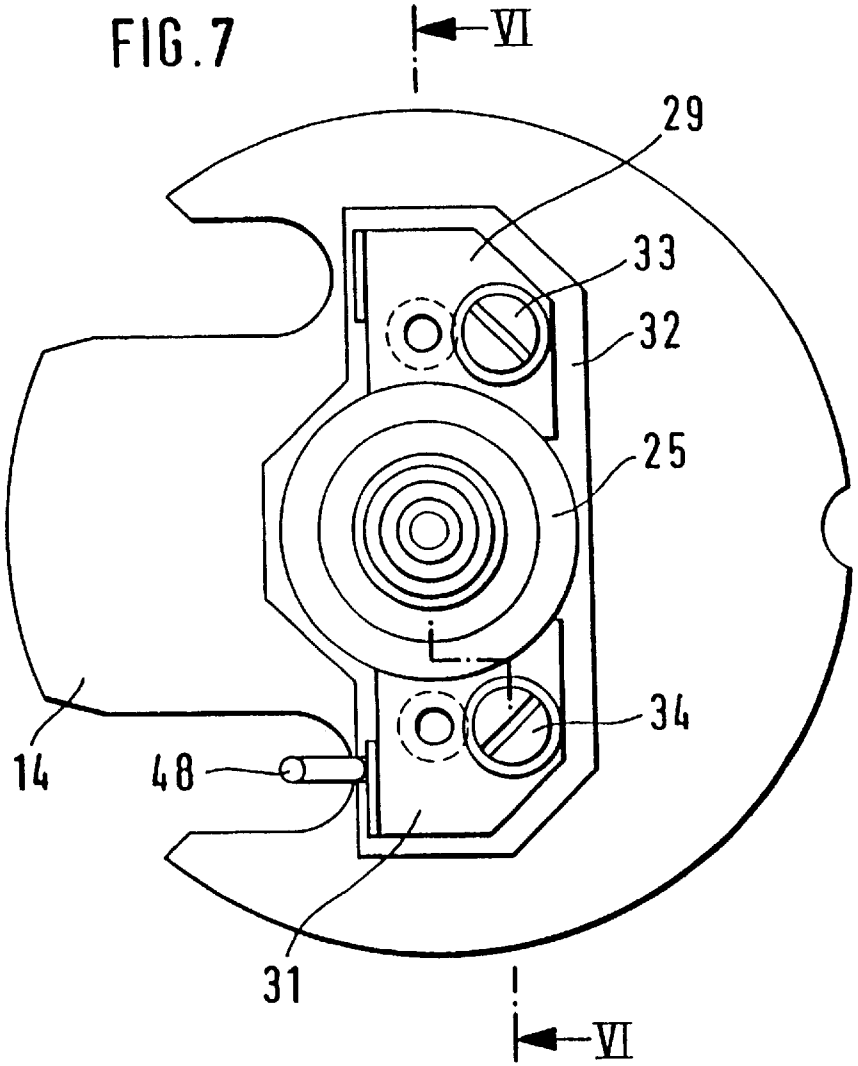
in FIG. 7, a front view of FIG. 6 in the direction of the arrow P2; and in FIG. 8, the resistor wound in meandering fashion.
Figure 6:
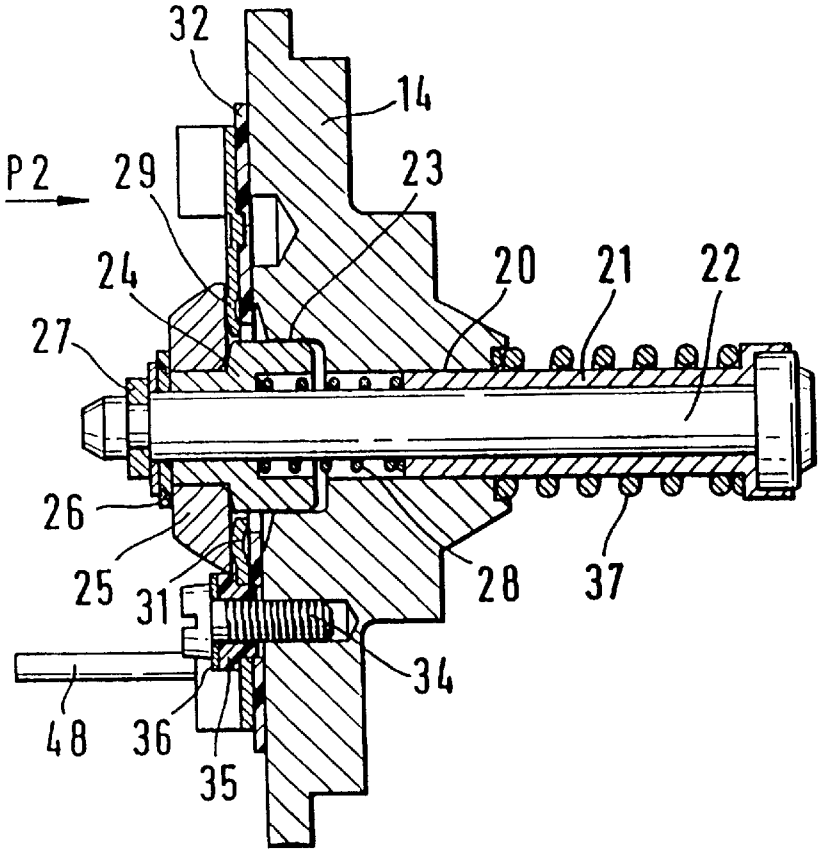
in FIG. 6, again a detail from FIG. 1 (switch pin with contact plate)

The contact plate 25 cooperates with two separate contacts 29, 31—see FIGS. 3, 6 and 7—which are secured to the outside of the magnet core 14 on an insulating plate 32; the insulating plate 32 is disposed on the magnet core 14. These parts are secured by screws 33, 34. Between the heads of the screws 33, 34 is a respective insulating bush 35 with a spring washer 36. A turn-off spring 37 extends on the outside of the switch pin 22, between the magnet core 14 and a shoulder of the insulating sleeve 21.

Figure 8:
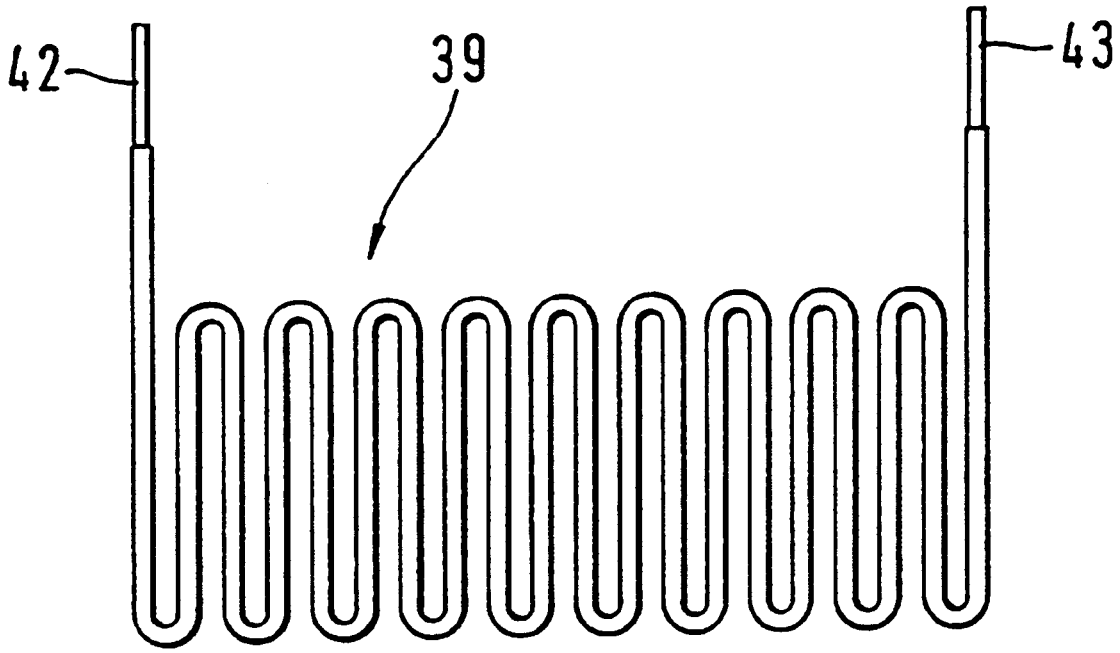

Located on the outside of the pull-in winding 11 is a resistor 39, wound of resistor wire, as shown in FIG. 8. It is wound in meandering fashion, provided with an insulator, and wrapped around the pull-in winding 11 in such a way that its beginning and end are close together. The ends of the resistor are designated by reference numerals 42, 43, and the ends of the pull-in winding 11 are designated by reference numerals 46, 47. See again FIG. 3, where 43 indicates the end of the resistor 39 and 42 indicates the beginning of the resistor 39. The end of the pull-in winding 11 is designated by reference numeral 47 and is connected to ground, by being firmly welded to the magnet core 14 as shown in FIG. 3. The beginning of the pull-in winding is designated by reference numeral 46.

See again FIG. 1. There, two connection screws 44, 45 are located in the switch cap 16; they are secured with nuts that are not identified by reference numeral, and their inner contacts 44A, 45A cooperate with the contact plate 25. The connection screw 45 is in contact with a contact rail 41, to which the end 43 of the resistor 39 is soldered.

Figure 2:
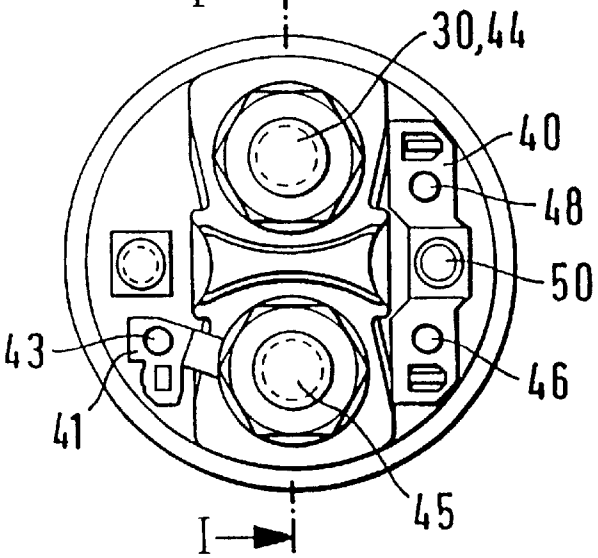
in FIG. 2, a front view of the relay of FIG. 1 in the direction of the arrow P1.
Figure 5:
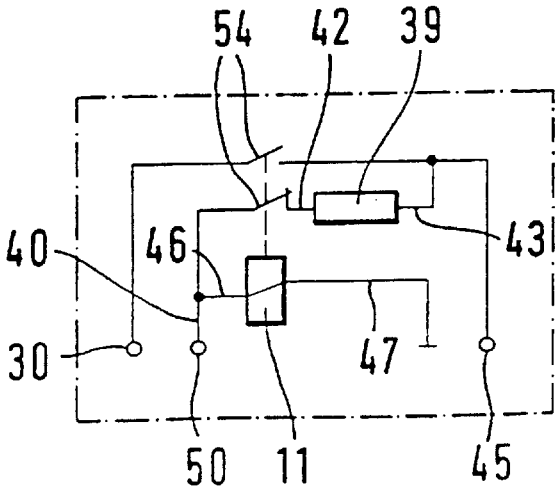
in FIG. 5, a circuit diagram of the relay.

The circuit diagram of FIG. 5 will now be described. The resistor 39 can be seen there. The connection screw 45 is shown symbolically, as is the terminal 50 with a connection rail 40 for soldering the winding circumference 46 and the contact 29 by means of a conductor 48, as shown in FIGS. 6 and 7 for a starter switch—see also FIG. 2. The positive terminal 30 for the battery connection is again shown symbolically—see also FIG. 2; the pull-in winding 11 can also be seen. The switchover contact between the connection terminal 50 and the resistor 39 is designated by reference numeral 54. It is embodied in FIG. 1 by the contact plate 25.

The pull-in winding 11, which is needed for pulling in the magnet armature 13, is designed as a single winding, to achieve the highest possible inductance. To generate the limited starter motor turning current required in the first stage, the resistor 39 is provided. In order not to generate any retention circuit for the magnet armature 13, this resistor must be galvanically separated from the connection terminal 50. This is accomplished with the aid of the switchover contact 54. The resistor 39 need be in operation only in the pull-in phase and must be turned off during the starting operation, to prevent it from being heat-damaged. This is accomplished with the aid of the contact plate 29, 31 (FIG. 7) disposed in insulated fashion. In the position of repose, the contact plate 25 rests on these contacts and thus forms an "opener". Once the magnet armature 13 touches the switch pin 22, or in other words once the pinion of the starter has reached the gear ring of the engine, this opener opens and it turns off the resistor 39, before the contact plate 25 meets the contacts 44A, 45A and turns the starter motor on fully. In the deactivation operation, the opener is not closed again until the main current at the contacts 44A and 45A is interrupted.

As a result of this separate triggering, it is possible to adapt both the resistor 39 and the pull-in winding 11, independently of one another, to requirements. As already noted, with the resistor 39 prewound in meandering fashion and curved into a ring, the beginning and end of the windings are located side by side.

What is claimed is:

1. An engagement relay for starters of internal combustion engines, in which a starter pinion is initially, by actuation of a pull-in winding, displaced axially for shifting into a gear ring of the engine, and after that, by actuation of a starter motor, via a switch of the engagement relay is driven at full force, wherein the switch is embodied as a switchover contact (54), which in the position of repose switches the starter motor for gentle startup to the electrical supply (+30) via a resistor (39) and directly to it in the working position, and then the resistor is turned off, the pull-in winding (11) carries the resistor (39), located on its outside, which resistor comprises a resistor wire wound in meandering fashion.

2. The engagement relay of claim 1, wherein the resistor (39), as a resistor wire wound in meandering fashion, is curved into a ring and thrust onto the pull-in winding (11) in such a way that the beginning (49) and end (48) of the resistor winding (39) are located close together.

3. The engagement relay of claim 1, having a cylindrical magnet armature (13), which cooperates with the pull-in winding (11) and actuates a spring-loaded switch pin (22) and which cooperates with an approximately disk-shaped magnet core (14) that partly closes the housing, a contact plate (25) being disposed on the switch pin, wherein on the one hand, in the working position, the contact plate cooperates with a contact pair (44A, 45A) for actuating the starter motor, and on the other, in the position of repose, with two contacts (29, 31), one of which cooperates with a starter switch via a terminal 50 and the other of which cooperates with a terminal 45 for the starter motor, and which contacts are disposed on a switch cap 16 of the engagement relay.

4. The engagement relay of claim 3, wherein the two contacts (29, 31) of the switchover contact (54) are disposed, spaced apart from one another, below an axially displaceable contact plate (25) and are secured in insulated fashion on the magnet core (14).

* * * * *